US005993263A

United States Patent [19]

Sampson

[11] Patent Number: 5,993,263

[45] Date of Patent: Nov. 30, 1999

[54] REDUCED MATING FORCE ELECTRICAL CONNECTOR

[75] Inventor: Stephen A. Sampson, Downers Grove, Ill.

[73] Assignee: Molex Incorporated, Lisle, Ill.

[21] Appl. No.: 08/911,971

[22] Filed: Aug. 15, 1997

[51] Int. Cl.[6] ..... H01R 17/00

[52] U.S. Cl. ..... 439/660; 439/79; 439/924.1

[58] Field of Search ..... 439/660, 79, 924.1, 439/634

[56] References Cited

U.S. PATENT DOCUMENTS

| | | | |
|---|---|---|---|
| 3,757,277 | 9/1973 | Yamanoue et al. | 439/660 |
| 4,343,523 | 8/1982 | Cairns et al. | 339/59 M |
| 4,607,907 | 8/1986 | Bogursky | 339/258 P |
| 4,687,267 | 8/1987 | Header et al. | 439/79 |
| 4,900,278 | 2/1990 | Yamada et al. | 439/857 |
| 4,936,786 | 6/1990 | Klein et al. | 439/76 |
| 5,080,604 | 1/1992 | Rider et al. | 439/357 |
| 5,085,601 | 2/1992 | Buchter et al. | 439/660 |
| 5,213,514 | 5/1993 | Arai | 439/79 |
| 5,219,294 | 6/1993 | Marsh et al. | 439/79 |
| 5,582,519 | 12/1996 | Buchter | 439/101 |
| 5,641,308 | 6/1997 | Bixler et al. | 439/660 |
| 5,658,154 | 8/1997 | Bumsted et al. | 439/532 |
| 5,766,025 | 6/1998 | Davis | 439/660 |
| 5,785,557 | 7/1998 | Davis | 439/660 |
| 5,795,194 | 8/1998 | Hahn | 439/660 |

FOREIGN PATENT DOCUMENTS

| | | | |
|---|---|---|---|
| 57-97392 | of 1982 | Japan . | |
| 8-2942 | 1/1996 | Japan | H01R 13/64 |

*Primary Examiner*—Paula Bradley
*Assistant Examiner*—Tho D. Ta
*Attorney, Agent, or Firm*—Charles S. Cohen; Robert J. Zeitler

[57] ABSTRACT

An electrical connector includes a dielectric housing having an forwardly projecting mating portion with a continuous or uninterrupted leading edge. A plurality of terminals are mounted on the housing with contact portions on at least one side of the forwardly projecting mating portion. A recess is formed adjacent the continuous leading edge of the mating portion in line with the contact portion of at least one of the terminals. The recess is deep enough to avoid at least initial engagement of the mating portion by a resilient contact of a mating connector.

20 Claims, 3 Drawing Sheets

REDUCED MATING FORCE ELECTRICAL CONNECTOR

FIELD OF THE INVENTION

This invention generally relates to the art of electrical connectors and, more particularly, to a system for providing a reduced mating force between the connector and a complementary mating connector.

BACKGROUND OF THE INVENTION

Generally, a typical electrical connector includes some form of dielectric or insulative housing which mounts a plurality of conductive terminals. The terminals have contact portions which are engageable by the contacts of a complementary mating connector or other connecting device. In most instances, the contacts of the mating connectors all engage simultaneously during the mating procedure.

One type of electrical connector includes a dielectric housing having an elongated flange with opposite ends and a mating portion projecting forwardly of the flange. The mating portion has opposite sides which, in some connectors, include a plurality of terminal-receiving channels in a side-by-side array extending rearwardly from a leading region of the mating portion. A plurality of terminals are mounted on the housing, with the terminals having blade-like contact portions in the channels. A complementary mating connector includes resilient cantilevered contacts which form sort of a mouth for receiving the mating portion of the first connector. The resilient cantilevered contacts on opposite sides of the mouth biasingly oppose each other to contact or engage the mating portion of the first connector therebetween. When the mating portion is inserted into the mouth between the resilient cantilevered contacts of the complementary mating connector, the contacts are engaged simultaneously during the mating procedure and a substantial mating force is required, particularly with the ever-increasing number of terminals mounted longitudinally of such connectors.

In addition to the problem of high insertion or mating forces, the resilient cantilevered contacts have a substantial "wear track" during the mating procedure until the contacts are fully engaged with the blade-like contact portions of the first connector. In other words, the cantilevered contacts "ride" or slide over part of the plastic housing until they engage the contacts of the other or first connector. By reducing the amount of plastic the cantilevered contacts engage, the amount of wear they undergo during mating and unmating is reduced.

The present invention is directed to solving these problems by providing an electrical connector of the character described, with a system which reduces the required mating forces and also reduces or shortens the wear track of the mating contacts.

SUMMARY OF THE INVENTION

An object, therefore, of the invention is to provide a new and improved electrical connector which includes a system for reducing the mating force of the connector with its complementary mating connector.

In the exemplary embodiment of the invention, the connector includes a one-piece dielectric housing having an elongated flange with opposite ends. A mating portion projects forwardly of the flange between the ends. The mating portion has opposite sides extending rearwardly from a continuous or uninterrupted leading edge. A plurality of terminals are mounted on the housing, and each terminal includes a contact portion on one side of the forwardly projecting mating portion for engagement by a resilient contact of an appropriate complementary mating connector. The invention contemplates that at least one side of the forwardly projecting mating portion include a recess adjacent the leading edge of the mating portion in line with the contact portion of at least one of the terminals. The recess is deep enough to avoid at least initial engagement of the mating portion by the resilient contact of the mating connector.

As disclosed herein, the recess extends rearwardly of the continuous or uninterrupted leading edge of the mating portion to a point adjacent a forward tip of the contact portion of the terminal. Preferably, the recess comprises an inclined ramp to gradually increase the mating force between the connectors. The contact portions of some of the terminals are longer than the contact portion of at least one other of the terminals, with the recess being in line with the contact portion of the other or shorter terminal. The invention is disclosed in a connector having a plurality of mating portions spaced longitudinally thereof, with some of the recesses on opposite sides of the plurality of mating portions.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
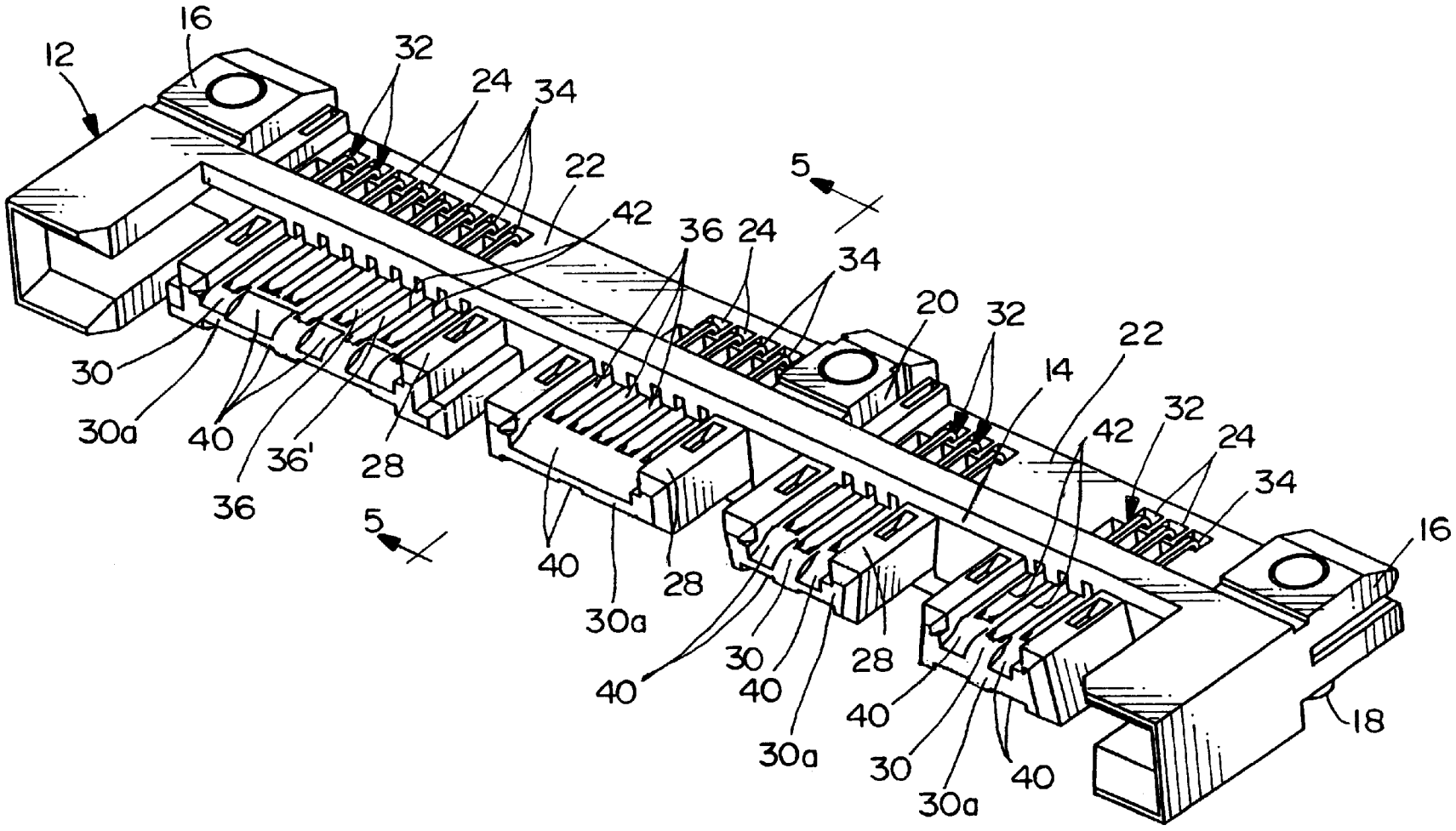
FIG. 1 is a front perspective view of an electrical connector according to the invention.
Figure 3:
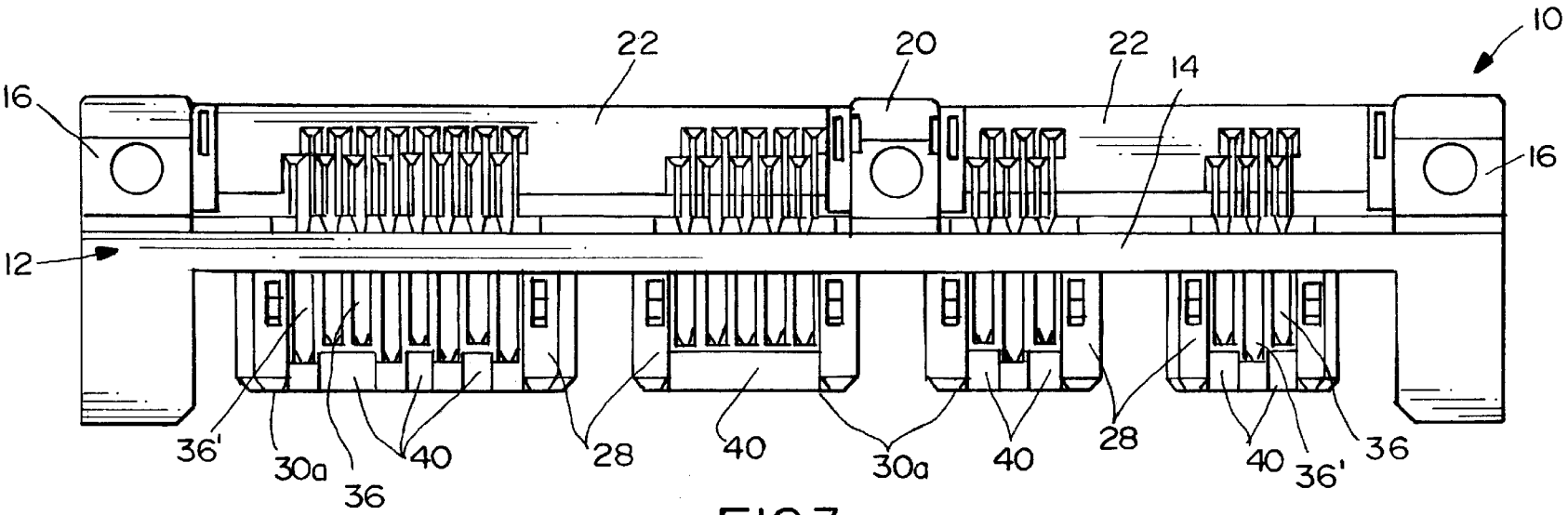
FIG. 3 is a top plan view of the connector.
Figure 2:
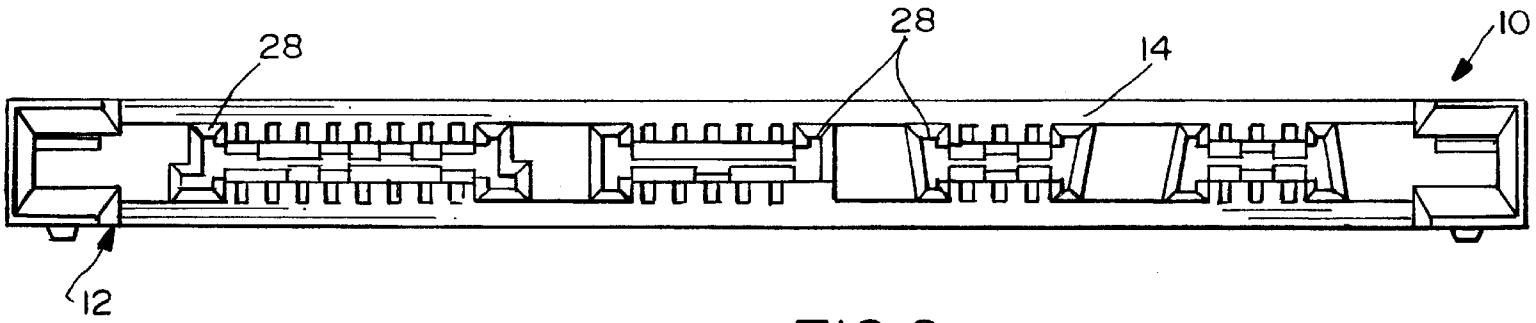
FIG. 2 is a front elevational view of the connector.
Figure 4:
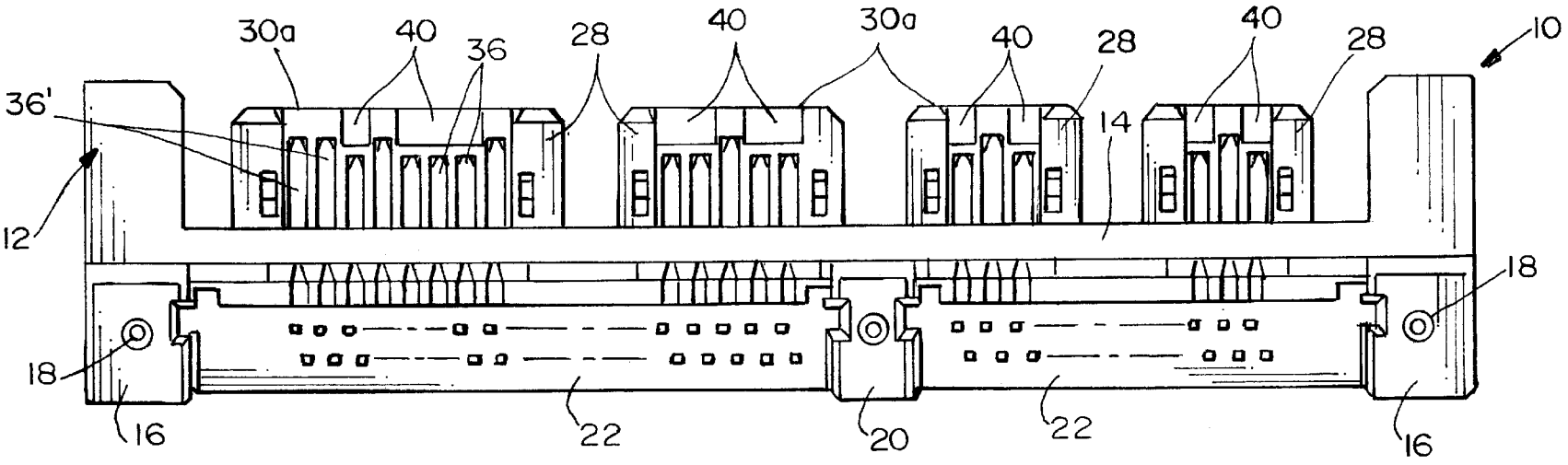
FIG. 4 is a bottom plan view of the connector.

Referring to the drawings in greater detail, the invention is incorporated in an electrical connector, generally designated 10, which includes an elongated dielectric housing, generally designated 12. The housing includes an elongated flange or body portion 14 extending between a pair of rearwardly extending end mounting portions 16 having depending mounting pegs 18 for insertion into appropriate mounting holes in a printed circuit board (not shown). The mounting portions project rearwardly of elongated flange 14, and a central mounting flange 20 also projects rearwardly of the elongated flange. A tail aligner plate 22, having tail aligning holes 24, extends longitudinally between each end mounting portion 16 and central mounting portion 20.

A plurality of discrete mating portions 28 are spaced longitudinally along flange 14 and project forwardly therefrom. Each mating portion includes an intermediate wall 30 which defines opposite sides of the mating portion. The opposite sides of wall 30 extend rearwardly from a continuous or uninterrupted leading edge 30*a* of the wall and the respective mating portion. The entire dielectric housing 12, including elongated flange or body portion 14, mounting portions 16 and 20, and mating portions 28, is unitarily molded of plastic material or the like.

Figure 5:
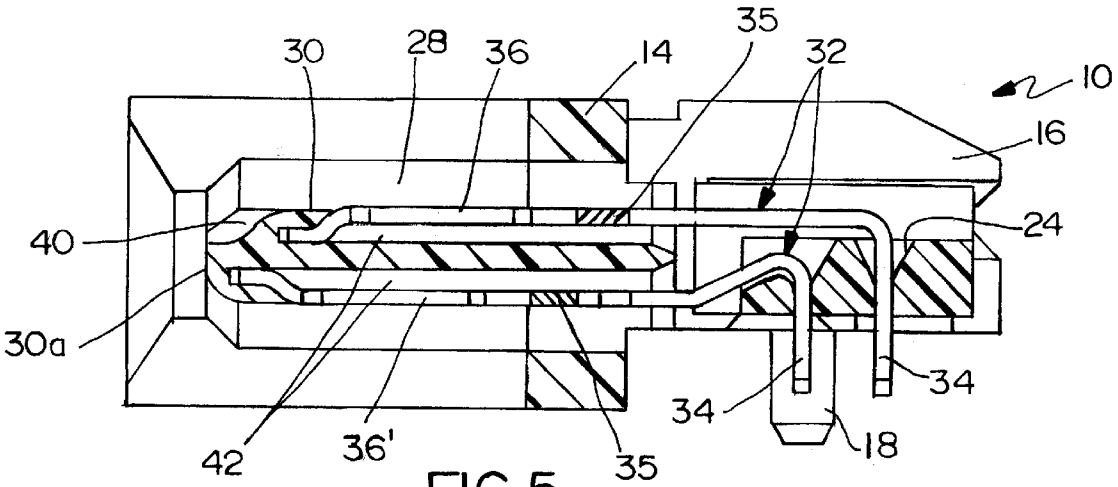
FIG. 5 is a vertical section taken generally along line 5—5 in FIG. 1.

A plurality of terminals, generally designated 32, are mounted on dielectric housing 12 and extend through elongated flange 14. The terminals include right-angled solder tail portions 34 which project through respective ones of tail aligning holes 24 in tail aligners 22 for connection to appropriate circuit traces on the printed circuit board. The terminals also have blade-like contact portions 36 projecting forwardly of elongated flange 14 and a terminal retention section 35 (FIG. 5). Generally, the contact portions are arranged in a side-by-side parallel array on each forwardly projecting mating portion 28. The contact portions of some of the terminals are exposed on the top surface of wall 30 of the respective mating portion 28, and the contact portions of others of the terminals are exposed on the bottom surface of wall 30 of the respective mating portion. The contact portions or blades 36 are disposed in channels 42 in the opposite sides of wall 30 so that the surfaces of the contact blades are generally flush with the opposite sides of the wall.

Still further, the terminal arrangement of electrical connector 10 provides a "first make-last break" system. In other words, as is seen clearly in FIGS. 1, 3, 4 and 5, some of the contact blades 36' are longer than others of the contact blades 36. The tips of the longer contact blades are closer to leading edge 30*a* of the respective mating portion 28 than the shorter contact blades. Therefore, if all of the resilient cantilevered contacts of the mating connector are of the same length, the mating contacts for the longer contact blades 36' will make engagement with the longer contact blades first and disengage from the longer contact blades last during the mating and unmating of the connectors.

As stated above, the invention contemplates the provision of a system for reducing the mating forces between connector 10 and the complementary mating connector. The system also reduces or shortens the "wear track" of the complementary mating contacts.

More particularly, it can be seen quite clearly in FIG. 1 that a plurality of recesses 40 are formed at select positions on opposite sides of walls 30 of mating portions 28 adjacent continuous or uninterrupted leading edge 30*a*. In essence, recesses 40 extend from leading edges 30*a* of the mating portions rearwardly toward the tips of contact blades 36, 36'. It is contemplated that recesses 40 be deep enough to avoid at least initial engagement of walls 30 of mating portions 28 by at least selected ones of the resilient contacts of the complementary mating connector. In addition, the portion of the recesses closest to the tip of shorter terminals 36 is curved to provide a smooth lead-in. Therefore, with less than all of the resilient contacts of the mating connector initially making engagement with any part of connector 10, the mating forces between the contacts and, thereby, between the mating connectors, is reduced.

FIG. 5 most clearly shows a feature of recesses 40, wherein the recesses are inclined in a ramp-like curved manner rearwardly of leading edge 30*a*. Therefore, the inclined ramp-shape of the recesses provides a gradual increase of the mating forces during the mating procedure of the connectors.

It should be pointed out that recesses 40 are located on mating portions 28 of connector 10 in line with the shorter contact blades 36 on each opposite side of each mating portion. This selective positioning of the recesses has been done in connector 10 because, as described above, connector 10 includes a "first make-last break" system involving the longer contact blades 36' and shorter contact blades 36. However, it should be understood that the invention is not limited to a first make-last break connector system. Providing recesses 40 in the otherwise continuous and uninterrupted leading edge 30*a* of the mating portions can be incorporated in a wide variety of connectors to "program" the mating forces involved. Greater or fewer numbers of recesses 40 can be employed on any individual mating portion to decrease or vary the mating forces between the two mating connectors.

As stated above, recesses 40 also reduce or shorten the "wear track" of the resilient contacts of the complementary mating connector. In other words, the mating contacts of the mating connector that are aligned with the recesses 40 slide over a shorter length of the housing than they would without the recesses, thus resulting in less wear. As a result of these recesses, the mating contacts of the mating connector undergo or "see" approximately the same amount of wear even though they engage the terminals 36, 36' at different locations.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector, comprising:

a one-piece dielectric housing having an elongated flange with opposite ends, a mating portion projecting forwardly of the flange between said ends, said mating portion having opposite sides extending rearwardly from a continuous leading edge;

a plurality of terminals mounted on the housing, each terminal including a contact portion on one of said opposite sides of the forwardly projecting mating portion of the housing for engagement by a resilient contact of an appropriate complementary mating connector; and at least one of said opposite sides of said forwardly projecting mating portion including at least one recess contiguous with the continuous leading edge of the mating portion and in line with the contact portion of at least one of said terminals, the recess being deep enough to avoid engagement of the mating portion by the resilient contact of the mating connector upon initial engagement of the mating connector to the mating portion.

2. The electrical connector of claim 1 wherein said recess extends rearwardly of the continuous leading edge of the mating portion to a point substantially adjacent a forward tip of the contact portion of said at least one terminal.

3. The electrical connector of claim 1, including one of said recesses on each side of said mating portion.

4. The electrical connector of claim 1 wherein the contact portions of some of said terminals extend a greater distance from the flange than at least one other of the terminals, and said recess is in line with the contact portion of the other terminal.

5. The electrical connector of claim 1 wherein said recess comprises an inclined ramp.

6. The electrical connector of claim 5 wherein said recess extends rearwardly of the continuous leading edge of the mating portion to a point substantially adjacent a forward tip of the contact portion of said at least one terminal.

7. The electrical connector of claim 1, including a plurality of said mating portions spaced apart longitudinally along said flange and projecting forwardly therefrom, with said recess on at least one of the mating portions.

8. The electrical connector of claim 7, including a plurality of said recesses on at least one of the mating portions.

9. The electrical connector of claim 7, including one of said recesses on each mating portion.

10. The electrical connector of claim 9, including one of said recesses on each side of each mating portion.

11. An electrical connector, comprising:

a one-piece dielectric housing having an elongated flange with opposite ends, a mating portion projecting forwardly of the flange between said ends, said mating portion having opposite sides extending rearwardly from a continuous leading edge;

a plurality of terminals mounted on the housing, each terminal including a contact portion on one side of the forwardly projecting mating portion of the housing for engagement by a resilient contact of an appropriate complementary mating connector; and at least one side of said forwardly projecting mating portion including at least one recess in the form of an inclined ramp contiguous with the continuous leading edge of the mating portion in line with the contact portion of at least one of said terminals, the recess extending rearwardly of the continuous leading edge to a point adjacent a forward tip of the contact portion of said at least one terminal.

12. The electrical connector of claim 11, including a plurality of said recesses on at least one of the mating portions.

13. The electrical connector of claim 11 wherein the contact portions of some of said terminals are longer than the contact portion of at least one other of the terminals, and said recess is in line with the contact portion of the other terminal.

14. The electrical connector of claim 11, including one of said recesses on each mating portion.

15. The electrical connector of claim 14, including one of said recesses on each side of each mating portion.

16. An electrical connector, comprising:

a housing having a flange from which a forwardly projecting mating portion extends, the mating portion having an uninterrupted leading edge;

a plurality of terminals mounted on the housing, each terminal including a contact portion on the forwardly mating portion of the housing for engagement by a contact of an appropriate complementary mating connector; and said forwardly projecting mating portion including a recess continuous with and extending rearwardly from the uninterrupted leading edge of the mating portion in line with the contact portion of at least one of said terminals, the recess being deep enough to avoid engagement of the mating portion by the contact of the mating connector upon initial engagement of the mating connector to the mating portion.

17. The electrical connector of claim 16 wherein said recess extends rearwardly of the uninterrupted leading edge of the mating portion to a point adjacent a forward tip of the contact portion of said at least one terminal.

18. The electrical connector of claim 16 wherein the contact portions of some of said terminals are longer than the contact portion of at least one other of the terminals, and said recess is in line with the contact portion of the other terminal.

19. The electrical connector of claim 16 wherein said recess comprises an inclined ramp.

20. The electrical connector of claim 19 wherein said recess extends rearwardly of the uninterrupted leading edge of the mating portion to a point adjacent a forward tip of the contact portion of said at least one terminal.

* * * * *